United States Patent [19]

Walter

[11] 4,275,623

[45] Jun. 30, 1981

[54] HAND TOOL

[76] Inventor: James Walter, 3110 Park Newport, Apt. 209, Newport Beach, Calif. 92660

[21] Appl. No.: 93,688

[22] Filed: Nov. 13, 1979

[51] Int. Cl.[3] ..... B25B 13/12

[52] U.S. Cl. ..... 81/126; 81/367

[58] Field of Search ..... 81/126, 129, 150, 367, 81/372, 381–383, 386, 393

[56] References Cited

U.S. PATENT DOCUMENTS

| | | | |
|---|---|---|---|
| 877,763 | 1/1908 | Deason | 81/150 X |
| 2,495,699 | 1/1950 | Clark | 81/376 |
| 2,772,591 | 12/1956 | Munroe | 81/367 X |
| 3,564,956 | 2/1971 | Landen | 81/126 |
| 3,672,245 | 6/1972 | Hoffman | 81/367 |

FOREIGN PATENT DOCUMENTS

| | | | |
|---|---|---|---|
| 24233 | 6/1918 | Denmark | 81/150 |

*Primary Examiner*—James G. Smith

*Attorney, Agent, or Firm*—Georges A. Maxwell

[57] ABSTRACT

An elongate, vice-like hand tool including an elongate case with front, central and rear hand-grip portions, a work-engaging head at the front end of the case and including fixed and movable parts, an elongate tension member having a front end coupled with a movable part of the head and extending rearward through the central portion to the rear portion of the case, a toggle mechanism in the rear portion of the case including a longitudinally shiftable bar with a front end coupled with the rear end of the member, a manually engageable first lever arm with a front end pivoted to the case and shiftable from an actuated position adjacent the case to an actuated position where its rear end is moved laterally from the case, a second lever arm with a front end pivoted to the first arm rearward of its pivotal axis and means releasably establishing driving engagement with the bar and coupled with the rear end of the second arm, said means releases driving engagement with the bar when the first arm is in its fully unactuated position whereby the bar and its related movable part can be shifted to adjust the head to engage a piece of work preparatory to moving the first arm to its actuated position; the toggle mechanism is such that when the first arm is moved from its unactuated to its actuated position, the bar and its related tension member are moved axially rearward in and through the case.

12 Claims, 12 Drawing Figures

HAND TOOL

This invention has to do with a hand tool and is particularly concerned with a tool having a pair of relatively movable work-engaging parts and novel manually operable toggle joint linkage to effect movement of said parts.

BACKGROUND OF THE INVENTION

In the hand tool art, there exists a well-known and widely used pliars type of tool, the spacing of the jaws of which are adjustable by means of manually operable screws and which include manually operable toggle joint linkage to move the jaws into and out of engagement with related work. The most well known brand of this type of tool is produced by Peterson Mfg. Co., Inc. of Dewitt, Nebraska, and sold under the tradename "Vice Grip". The basic vice grip type of tool is the subject matter of U.S. Pat. No. 2,299,454 entitled "Wrench" and issued Oct. 20, 1942 to H. C. Borshers.

Prior and subsequent to the noted Borshers patent, many wrenches similar to the Borshers wrench and utilizing toggle joint linkage to move the jaws were and have been provided by the prior art. Common characteristics found in the majority of those prior art wrenches or hand tools are: they include one fixed or stationary jaw; one movable jaw which is pivotally related or slidably related to the fixed jaw; and manually operable toggle joint linkage to move the jaws towards each other and including a compression part in direct driving engagement with the movable jaw to exert working forces on and through the movable jaw when the linkage is operated.

Due to the basic structures and principles of operation of the above noted prior art wrenches and the manner and/or direction in which the art has developed, substantially all of those wrenches are short, hand-held units and such that they cannot be effectively lengthened or extended to meet the needs for elongated wrenches and the like for engaging work in remote and hard to reach places.

OBJECTS AND FEATURES OF THE INVENTION

An object and feature of my invention is to provide a novel manually operated toggle joint type of operating linkage for a wrench or similar hand tool which includes and operates to effect axial movement of and to exert tensile forces in and through an elongate operating rod extending to and connected with a movable part of a work-engaging head located remote from the operating linkage.

Another object and feature of this invention is to provide a manually operable operating linkage of the character referred to above which includes a mechanism for selective longitudinal shifting and adjustment of the operating rod relaive to the toggle joint linkage whereby the movable part of the work engaging head can be moved to facilitate engagement of the head with a piece of work prior to actuating the linkage.

It is an object and feature of my invention to provide a structure of the character referred to above including an elongate case or housing having a forward end carrying the work engaging head; a rear manually engageable grip end housing the linkage; and an intermediate portion through which the operating rod extends.

Yet another object and feature of my invention is to provide a hand tool of the general character referred to above wherein the length of the intermediate portion of the housing can be varied widely as desired or as circumstances require and wherein the work engaging head can be any desired mechanism or device which is capable of being secured to and carried by the front end of the housing and which can be operated to perform its intended function by means of the operating rod.

The foregoing and other objects and features of the invention will be apparent and will be fully understood from the following detailed description of the invention throughout which description reference is made to the accompanying drawings.

DETAILED DESCRIPTION OF THE INVENTION

Figures 1, 2, 3:
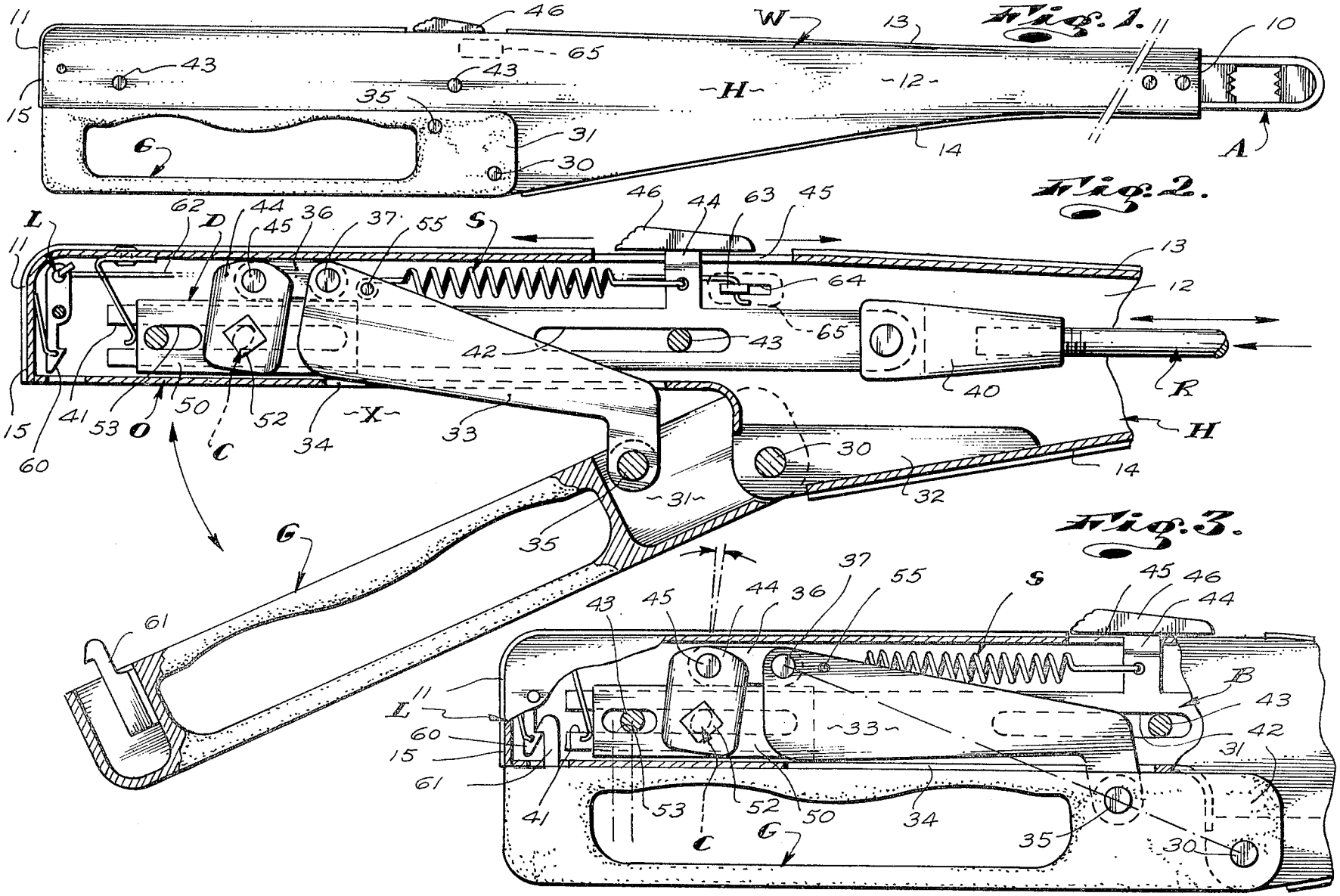
FIG. 1 is a side elevational view of my new hand tool.
FIG. 2 is an enlarged detailed view of the rear end portion of the structure shown in FIG. 1 with portions broken away to illustrate details of the construction.
FIG. 3 is a view of structure shown in FIG. 2 with parts in different positions.

In FIG. 1 of the drawings, I have shown an elongate hand tool or wrench W embodying my invention. The wrench W includes an elongate case or housing H with front and rear ends 10 and 11.

The housing H is a fabricated sheet metal structure having flat opposite vertical side walls 12, top and bottom walls 13 and 14 and a rear wall 15. The front end of the housing H is open.

For the purpose of best describing the invention the housing H can and will be defined as having front, rear and intermediate portions. The housing can be substantially equal in lateral extent throughout its longitidunal extent while its rear portion is preferably greater in vertical extent than its front portion. The intermediate portion is tapered longitudinally to fare smoothly into and join with its related front and rear portions.

The lower rear portion of the rear portion of the housing H is relieved to define a recess X to accommodate a manually engageable part of the construction, which part will be fully described in the following.

In practice, and to facilitate manufacture and assembly of the construction, the housing H is sectional and includes two opposing half sections, each defining one side wall 12 and related portions of the top, bottom and rear walls 13, 14 and 15. The related portions of the top, bottom and rear walls of each half-section have marginal portions which establish lapped and seated engagement with corresponding marginal portions of the other half section.

In practice, the half sections of the housing H are releasably held in assembled relationship by other related parts of the construction and by independent fastening means. Since the independent fastening means employed to hold the half sections assembled can vary widely in practice and have no real effect on the functional aspects of the invention, I have elected not to burden this disclosure by illustrating such independent fastening means. It will suffice to note that suitably warranted tiebolts or similar fastening means engaged through and extending between the side walls of the housing would suffice to releasably hold the half sections together.

Referring to FIGS. 1 and 9 through 12 of the drawings, the wrench W next includes a work engaging head A at and projecting forwardly from within the open front end 10 of the housing H. The head A is shown as including an elongate stationary or fixed jaw J with a rear end portion engaged in the front end portion of the housing H and fixed thereto by through fasteners 16, and the front end portion projecting forwardly from the front end of the housing. The front end of the jaw J has forwardly disposed serrated work engaging front end 17. The jaw J has straight parallel top and bottom sides or edges which are in predetermined spaced relationship from and oppose their related top and bottom walls 13 and 14 of the housing.

The head A next includes a forward or front elongate movable Jaw $J^1$ normally spaced forward from and in axial alignment with the jaw J and having a rearwardly disposed serrated work engaging end 18.

The head A next includes a carrier means for the movable jaw $J^1$ which carrier means includes an elongate U-shaped yoke 19 having upper and lower longitudinally extending legs and a forward base at and between the forward ends of the legs. The movable jaw $J^1$ is seated on the base and between the legs of the yoke and is fixed therein by suitable screw fasteners, as shown in dotted lines in FIG. 9 of the drawings. The legs of the yoke 19 project freely rearwardly from the jaw $J^1$ into free sliding engagement with the top and bottom edges of the fixed jaw and their related top and bottom walls 13 and 14 of the housing.

The rear end portions of the legs of the yoke terminate within the front portion of the housing in rearward spaced relationship from the fixed jaw J.

Figures 4, 5, 6, 7, 8, 9, 10, 11, 12:
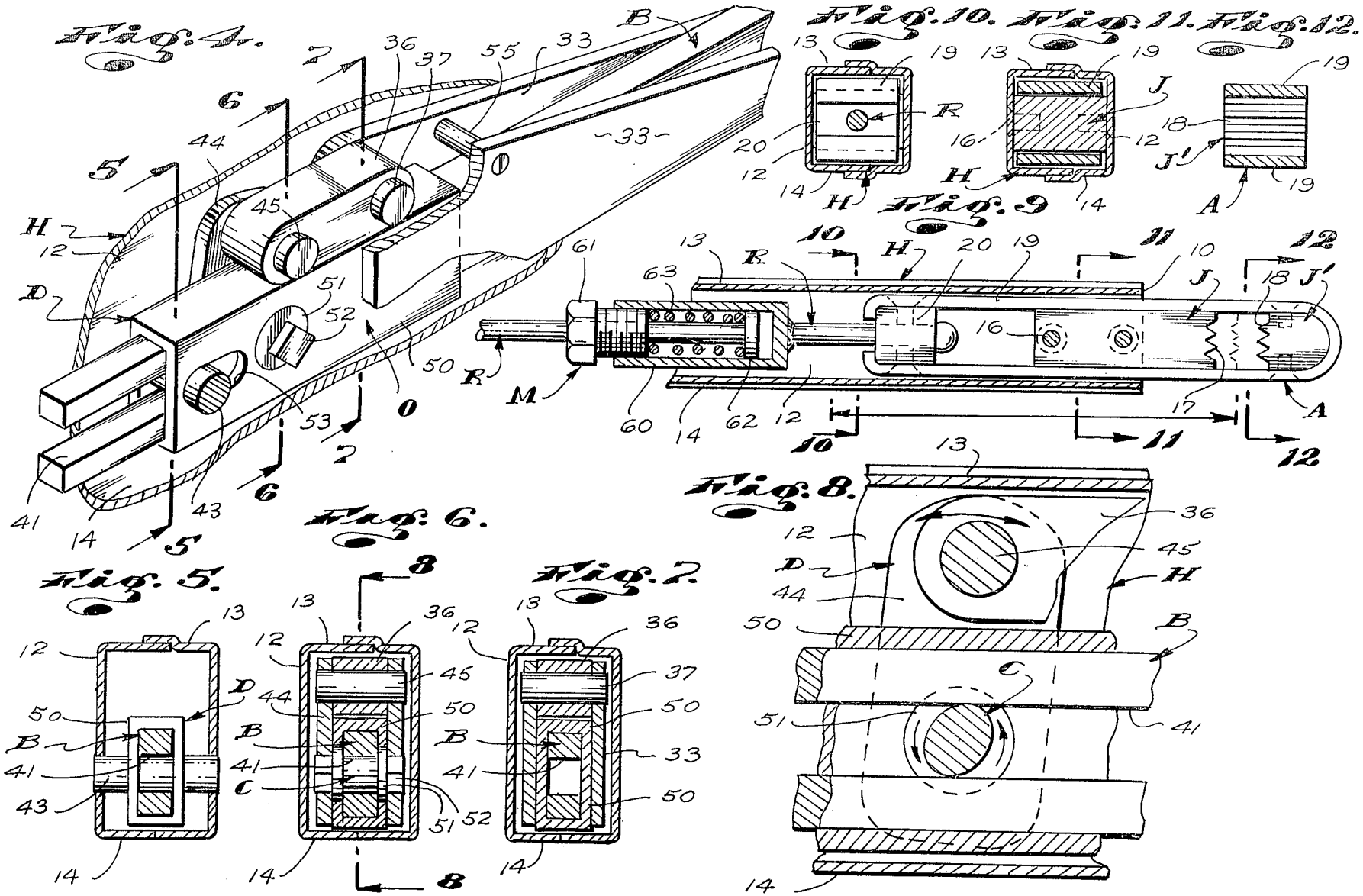
FIG. 4 is an isometric view of structure shown in FIG. 2.
FIG. 5 is a view taken substantially as indicated by line 5—5 in FIG. 4.
FIG. 6 is a view taken substantially as indicated by line 6—6 in FIG. 4.
FIG. 7 is a view taken substantially as indicated by line 7—7 in FIG. 4.
FIG. 8 is an enlarged detailed view taken substantially as indicated by line 8—8 in FIG. 6.
FIG. 9 is a longitudinal sectional view of the front end portion of the structure shown in FIG. 1.
FIG. 10 is a sectional view taken substantially as indicated by line 10—10 in FIG. 9.
FIG. 11 is a sectional view taken substantially as indicated by line 11—11 in FIG. 9.
FIG. 12 is a sectional view taken substantially as indicated by line 12—12 in FIG. 9.

The rear ends of the legs of the yoke are shown as having inwardly turned ends which establish hooked engagement with the rear end of an elongate drive block 20 engaged between the rear end portions of the yoke and which is secured therewith by screw fasteners, as shown in dotted lines in FIG. 9 of the drawings.

The drive block 20 has a central longitudinal opening in and through which the forward end of an elongate longitudinally extending drive rod R is suitably engaged to establish driving engagement therewith.

With the head A illustrated in the drawings and described above, it will be apparent that by moving the rod R and the yoke 19 axially, the spacing of the jaws J and $J^1$ can be adjusted to accommodate a piece of work, such as the head of a bolt (not shown) and that upon exerting tensile forces onto and through the rod, the jaw $J^1$ can be moved and urged rearwardly towards the jaw J with the related work or bolt-head in tight clamped engagement therebetween.

It will be apparent that if desired, one of the legs of the yoke 19 can be made larger and/or rigid and the other leg can be cut away so as to provide open vertical access as well as lateral access to the space between the jaws.

Still further, it will be readily seen that the head A can be replaced by various work engaging devices having at least two relatively movable parts, one of which can be fixed to the housing and the other of which can be operatively connected with the rod R and operated by axial movement of that rod. For example, it will be apparent that the fixed jaw J can be replaced by a fixed blade of a shearing device and the movable jaw can be replaced by a bell crank, pivotally carried by the fixed blade. One arm of the bell crank would be coupled to the rod R and the other arm of the bell crank would establish or would carry a second blade of the shearing device.

In accordance with the above, and in accordance with the broader aspects of my invention, it will be apparent that the work engaging head can vary widely in form and in details of construction and that its basic components can be said to include a fixed work engaging part of the housing H and a movable work engaging part, movable relative to the fixed part and coupled with the drive rod R.

Referring next to FIGS. 1 through 8 of the drawings, the wrench W that I provide includes actuating means O to effect axial shifting of the rod R. The means O includes manually operable toggle joint linkage at and within the rear end portion of the housing H.

The means O first includes an elongate manually engageable first lever arm or grip G having a front end pivotally connected with the housing H by a pivot pin 30 immediately forward of the recess X in the rear portion of the housing and operable to pivot between an up or horizontal actuated position immediately below the housing H (as shown in FIGS. 1 and 3 of the drawings) and a down or unactuated position as clearly shown in FIG. 2 of the drawings, where the arm extends rearwardly and downwardly from the housing.

In the form of the invention illustrated, the first arm or grip G has a pair of forwardly extending cheek plates 31 overlying related portions of the opposite side walls 12 of the housing H. The housing H is provided with a mounting block 32 forward of the recess X. The pivot pin 30 is engaged in and through registering openings in the block 32, side walls 12 and cheek plates 31.

The operating means O next includes a second elongate lever arm 33 with a lower front end and an upper rear end. The upper rear end portion of the second lever arm 33 occurs within the upper rear end portion of the housing H and its lower front end portion extends through an opening 34 in the bottom wall 14 of the housing, at the top of the recess X, into the forward portion of the recess X and between the cheek plates 31 of the grip G. The lower front end of the lever arm 33 is pivotally connected to the first lever arm or grip G, between the cheek plates 31 thereof by a pivot pin 35 engaged in and through registering openings in the related parts, as clearly shown in FIGS. 2 and 3 of the drawings.

The upper rear end of the second lever arm 33 is pivotally connected with the forward end of an elongate axially shiftable link 36 guided and retained within the upper rear portion of the housing H, by a pivot pin 37.

When the first lever arm or grip G is in its actuated or up position, as shown in FIGS. 1 and 3 of the drawings, the several pivot pins 30, 35 and 37 are in alignment with each other and the upper rear end of the arm 33 and the link 36 connected or coupled therewith are moved to a rear actuated position in the construction. When the grip G is moved down and forward to its unactuated position, as shown in FIG. 2 of the drawings, the pivot pin 35 is moved forwardly and downwardly from alignment between the pins 30 and 37 and the upper end of the arm 33 and its related link 36 are moved forwardly within the housing to a forward unactuated position therein.

It will be apparent that the arm 33 and the portion of the grip G extending between the pin 30 and 35 establish a toggle joint which, when moved from its unactuated to its actuated position exerts equal and opposite forces at the pins 30 and 37 and urges the movable link 36 rearward from its unactuated to its actuated position, with great force.

In the form of the invention illustrated and to afford proper balance and smooth operation of the construction, the means O includes two laterally spaced second lever arms 33 between which the forward end of the link 36 is engaged. Further, to allow for the arms 33 and grip G to establish their actuated position without interference, the arms 33 are in the nature of bell cranks having upper substantially horizontal rear arms of major longitudinal extent which occur wholly within the housing H and short substantially vertically lower forward arms which depend from within the housing and between the cheek plates 31 of the grip G when the construction is in its actuated position, as clearly shown in FIG. 3 of the drawings.

The means O next includes an elongate drive bar B extending longitudinally through the lower rear portion of the housing H and between the second lever arms 33. The forward end of the drive bar B is drivingly coupled with the rear end of the drive rod R by means of a clevis fitting 40, as clearly shown in FIG. 2 of the drawings.

The bar B has an elongate axially extending laterally opening slot 41 in its rear end portion. The slot 41 has straight flat parallel opposing top and bottom surfaces.

In practice, the bar can include a similar forward slot 42.

The housing H carries a pair of longitudinally spaced laterally extending guide pins 43 engaged in and through registering openings in the side walls 12 and through the slots 41 and 42, to orient and guide the bar longitudinally within the housing H.

Finally, the bar B has an upwardly projecting post 44 at its forward portion. The post 44 projects upwardly through an elongate longitudinally extending slot 45 in the top walls 13 of the housing H and carries a finger or thumb engaging pad 46. It will be apparent that by manually engaging the thumb pad 46 and urging it longitudinally of the housing H, the bar B, and the rod R and jaw $J^1$ related thereto can be moved longitudinally so as to adjust the longitudinally positioning of the movable jaw $J^1$ relative to the fixed jaw J, as circumstances require.

The means O next includes releasable drive means D between the link 36 and the bar B which means normally establishes and maintains driving engagement between the link and the bar and releases engagement between the link and the bar when the construction is in its fully unactuated position.

The drive means D includes an elliptical cam C (best shown in FIG. 8 of the drawings) engaged in and extending laterally through the slot 41 in the bar B, forward of the pin 43. The cam C is carried by and extends between the lower ends of a pair of laterally spaced substantially vertical lever plates 44, the upper ends of which are pivotally connected with the rear end of the link 36 by a pivot pin 45.

The cam C is such that when the means O is in its unactuated position and the link 36 is moved to its forward position, the cam is rotated out of wedging engagement with and between the top and bottom surfaces of the slot 41. As soon as the means O commences to move from its unactuated to its actuated position and the link 36 commences to move rearwardly to its rear position, the upper portions of the lever plates 44 are turned or rocked rearwardly and the cam C is turned so as to establish wedging locking engagement in the slot 41 and with the bar B.

With the means D described above, it would be apparent that when the cam C is released from driving engagement with the bar B, the bar B can be freely manually moved axially of the construction, to adjust the positioning of the jaws J and $J^1$ of the head A by means of the thumb pad 46. After the bar B has been moved and the jaws of the head A have been adjusted in the manner set forth above, and upon the initial movement of the grip G from its unactuated to its actuated position, the cam C locks with the bar B and the bar, rod and movable jaw of the head A are moved to their actuated positions.

In practice, and to afford appropriate support or backup for the portions of the bar B, defining the slot 41, the means O includes an elongate tubular carriage 50 engaged about and slidable longitudinal of the bar B. The carriage 50 supports and prevents vertical biasing of the portions of the bar B defining the slot 41, when acted upon by the cam C.

The carriage 50 has a pair of axially aligned openings which rotatably receive flanges 51 at the opposite ends of the cam C. The flanges 51 are formed integrally with the cam and have integrally formed axially outwardly projecting polygonal drive bosses 52 which enter and establish rotary driving engagement in polygonal openings in the lower ends of the lever plates 44.

The link 36 occurs above and normally establishes longitudinal sliding free engagement with and between the top of the carriage 50 and top wall 13 of the housing, as clearly shown in the drawings.

In practice, the rear end portion of the carriage has longitudinal slots 53 in its opposite sides. The slots 43 are substantially equal in longitudinal extent with the distance of travel afforded by the toggle linkage when moved from its actuated to its unactuated position. The slots 43 slidably accommodate the aforementioned guide pin 43.

Finally, the means O includes an elongate tension spring S within the housing H and coupled with and extending between the post 44 of the bar B and an anchor pin 55 carried by and extending between the upper rear end portions of the second lever arms 33. When the construction is in its unactuated position, the spring S normally yieldingly urges the second lever arms 33 and their related link 36, plates 44, cam C and carriage 50 forwardly to that position where the pin 43 stops at the rear end of the slots 53 in the carriage. At the same time, the spring S yieldingly urges the bar B and its related rod R and jaw $J^1$ rearwardly. Accordingly, when the construction is in its unactuated position, the forward movable jaw $J^1$ is yieldingly moved rearwardly toward the fixed jaw J by the spring S and can be manually moved forwardly to accommodate a piece of work between the jaws by means of the finger pad 46. During or while the bar B and jaws J and $J^1$ are being adjusted in the manner set forth, the carriage 50 and cam C are yieldingly held in their forward position by the spring S, ready to establish driving engagement with and to move the bar rearwardly when the construction is actuated.

It is to be noted that the pin 43 carried by the housing H and engaged in the slots 53 in the carriage 50 stops the operating means O when it is moved to and reaches its fully unactuated position and that the spring S yieldingly urges and holds the construction in that position.

In practice, the pins 30, 35 and 37 of the toggle joint portion of the construction are in line when the construction reaches its actuated position. That joint of construction does not move over center in such a manner as to cause the jaws to separate and release forces on related work, when the construction reaches full actuation. Accordingly, there is nothing in the construction thus far described to prevent the construction from freely moving out of its fully actuated position.

In furtherance of my invention, I provide a releasable latch means L which releasably holds the construction in its actuated position. The latch means L includes a downwardly projecting spring loaded pall 60 pivotally mounted on and carried by the rear wall 15 of the housing H and a normally upwardly projecting complimentary pall 61 fixed to and projecting upwardly from the rear end of the grip G and releasably establishing hooked or inter-engaged relationship with the pall 60 when the construction is in its fully actuated position and as shown in FIG. 3 of the drawings. The spring loaded pivotally mounted pall has an upwardly projecting lever arm which is connected with the rear end of a thin pull rod or wire 62 within and extending longitudinally of the rear portion of the housing H adjacent one side of the means O. The wire 62 extends forwardly in the housing to a location conveniently near the post 44 on the bar B and the thumb pad 46. The forward end of the wire 62 is connected with the inner end of a post 63 extending outwardly through a slot 64 in a side wall 12 of the housing. The post 63 carries a finger engageable latch release pad 65, shown in dotted lines in FIGS. 1 and 2 of the drawings. When the latch L is made up, it is easily and conveniently released by manually engaging and urging the pad 65 forwardly.

The illustration and description of the latch means L has been limited so as not to unduly burden this disclosure and because the form and details of construction of that means is subject to wide variations without departing from or affecting the broad aspects of the novelty of my invention.

In practice, the structural limits or strength of the construction here provided might be so limited that the power or forces generated by the toggle linkage will cause damage to and failure of the construction if it is forcibly urged to its actuated position. So as to prevent such damage, the rod R can be provided with a lost motion unit or means M which is made or adjusted to yield and prevent relative motion between the jaws of the work engaging head A when the tensile forces exerted into and through the rod R exceed a predetermined maximum or safe operating force.

The unit or means M can be engaged between either end of the rod R and the part of the construction related thereto or can be incorporated in or engaged between sections of the rod.

In FIG. 9 of the drawings, I have shown a lost motion means M comprising an outer cylindrical case 60 fixed to and extending axially from the end of one section of the rod and freely receiving a related end portion of the other section of the rod. The free end of the cylinder threadedly carries an axially adjustable spring stop 61. The free end of said other section of the rod carries a spring stop 62. A compression spring 63 is engaged in the annulus between said other sections of the rod and the cylinder and between the stops 61 and 62. It will be apparent that the means M shown and described above is such that when the tensile forces exerted through the rod R exceeds the force of the spring 63, the spring will yield and allow the sections of the rod to move axially away from each other and thereby limit the force exerted in and through the head A of the construction. It will be further apparent that by adjusting the stop 61, the operating force of the means M can be suitably adjusted.

The particular means M that I have elected to illustrate and have briefly described in the foregoing is but one of several well known forms of force relieving lost motion means that might be advantageously used in carrying out my invention.

In practice, instead of providing the lost motion means at or in the rod R, lost motion means can be provided at the pivot pin 30 or pivot pin 35 of the toggle joint linkage without departing from the spirt of this invention.

It will be apparent from the foregoing that hand tools or wrench construction embodying my invention can be made in many different lengths to make engagement of hard to reach work both easy and convenient; that the work engaging head at the free end of the tool can take many different forms and that the housing H is such that the tool can be made in many different and distinct designs, as desired, or as circumstances require.

In practice, and to assure that the cam C establishes locked engagement with the bar B upon movement of the construction from its unactuated to its actuated position, a suitable spring means can be provided to normally yieldingly urge the carriage 50 forward and to thereby normally set the cam with the bar, preparatory to the delivery of driving forces therebetween. In FIGS. 2 and 3 of the drawings, the above referred to spring means is shown as a simple leaf spring having an upper end anchored to the top wall 13 of the housing and a lower end engaging the rear end of the carriage and biased rearwardly thereby.

Having described only one typical preferred form and application of my invention, I do not wish to be limited to the specific details herein set forth but wish to reserve to myself any modifications and/or variations that may appear to those skilled in the art and which fall within the scope of the following claims:

I claim:

1. A hand tool comprising an elongate housing having a front end portion, a central portion and a rear handle portion, a work-engaging head secured to and projecting from the front end portion of the housing and including stationary and movable work engaging parts, an elongate tension rod extending through the central portion and between the front end and rear handle portions of the housing, means drivingly coupling a movable part of the head with the front end of the rod, manually operable operating means to selectively move the rod longitudinally from an unactuated forward position to an actuated rear position and to cause the head to work on a piece of work engaged with and between parts thereof, said operating means includes an elongate manually engageable finger grip with front and rear ends, a first pivot pin pivotally mounting the front end of the grip with the housing at the front end of the handle portion, an elongate lever arm with a rear end and a front end, a second pivot pin pivotally connecting the front end of the lever arm with the grip on an axis spaced rearward from the axis of the first pivot pin, a third pivot pin carried by the rear end of the lever arm on an axis spaced rearward from the axis of the second pivot pin, and drive means between the rear end of the rod and the third pivot pin, said grip is manually pivotally movable about the axis of the first pivot pin from an actuated position where it is substantially parallel with and adjacent said handle portion and where said first, second and third pivot pins are in substantial alignment with each other and said third pivot pin is in a rear actuated position to an unactuated position where its rear end is spaced from the housing and the second pivot pin is moved from alignment between the first and third pivot pins and the third pivot pin is moved forward to an unactuated position.

2. The hand tool set forth in claim 1 wherein the work engaging head includes a fixed work engaging part secured to and projecting from the front end portion of the housing, an elongate part with a rear end rearward of the fixed part and drivingly connected with the front end of the rod and a forward end terminating forward of the housing and a movable work engaging part movable relative to the fixed part and connected with the front end of said elongate part.

3. The hand tool set forth in claim 2 wherein said drive means includes an elongate longitudinally shiftable drive bar in the handle portion and having a front end drivingly coupled with the rear end of the rod, an elongate pivot plate adjacent to and extending transverse the axis of the bar, means pivotaly coupling one end of the plate with said third pivot pin and a cam at the other end of the plate establishing driving engagement with the bar when the third pivot pin moves rearward toward its actuated position and breaking driving engagement with the bar when the third pivot pin moves forward toward its unactuated position; and manually engageable means carried by the bar and accessible at the exterior of the housing to selectively move the bar longitudinally and to adjust the positioning of said movable part relative to said fixed part when the tool is in its unactuated position.

4. The hand tool set forth in claim 1 wherein said drive means includes an elongate longitudinally shiftable drive bar in the handle portion and having a front end drivingly coupled withe the rear end of the rod, an elongate pivot plate adjacent to and extending transverse the axis of the bar, means pivotally coupling one end of the plate with said third pivot pin and a cam at the other end of the plate on an axis parallel with the axis of the third pivot pin and establishing driving engagement with the bar when the third pivot pin moves rearward toward its actuated position and breaking driving engagement with the bar when the third pivot pin moves forward toward its unactuated position; and manually engageable means carried by the bar and accessible at the exterior of the housing to selectively move the bar longitudinally and to adjust the positioning of said movable part relative to said fixed part when the tool is in its unactuated position.

5. The hand tool set forth in claim 4 wherein said bar has an elongate longitudinally extending slot in and through which said cam extends, said means pivotally coupling said one end of the plate to the third pivot pin includes an elongate longitudinally extending longitudinally shiftable link adjacent the bar and having one end pivotally connected with the third pivot pin and its other end pivotally connected with said one end of the plate by a fourth pivot pin on an axis parallel with the axis of the third pivot pin.

6. The hand tool set forth in claim 4 wherein the operating means includes an elongate tension spring forward of the third pivot pin and extending longitudinally of the bar and having its forward end connected with the bar and its rear end connected with the rear end portion of the lever arm forward of the third pivot pin to normally yieldingly urge the bar rearwardly toward its actuated position and yieldingly urging said drive means and operating means toward their normal actuated positions.

7. The tool set forth in claim 6 which further includes manually releasably latch means including interengageable parts carried by said handle portion and the grip and normally releasably holding the grip in its actuated position.

8. The tool set forth in claim 1 which further includes manually releasably latch means including interengageable parts carried by said handle portion and the grip and normally releasably holding the grip in its actuated position.

9. The tool set forth in claim 2 which further includes manually releasably latch means including interengageable parts carried by said handle portion and the grip and normally releasably holding the grip in its actuated position.

10. The tool set forth in claim 3 which further includes manually releasably latch means including interengageable parts carried by said handle portion and the grip and normally releasably holding the grip in its actuated position.

11. The tool set forth in claim 4 which further includes manually releasably latch means including interengageable parts carried by said handle portion and the grip and normally releasably holding the grip in its actuated position.

12. The tool set forth in claim 5 which further includes manually releasably latch means including interengageable parts carried by said handle portion and the grip and normally releasably holding the grip in its actuated position.

* * * * *